US005232017A

United States Patent [19]

Jolley

[11] Patent Number: 5,232,017

[45] Date of Patent: Aug. 3, 1993

[54] GAS CYLINDERS VENTURI DIP TUBE

[75] Inventor: Simon A. Jolley, Surrey, England

[73] Assignee: The BOC Group plc, Surrey, England

[21] Appl. No.: 742,967

[22] Filed: Aug. 9, 1991

[30] Foreign Application Priority Data

Nov. 17, 1990 [GB] United Kingdom ..... 025040

[51] Int. Cl.[5] ..... E03B 11/00

[52] U.S. Cl. ..... 137/590; 137/888

[58] Field of Search ..... 137/590, 888; 141/2, 141/3, 18, 20

[56] References Cited

U.S. PATENT DOCUMENTS

| | | | |
|---|---|---|---|
| 2,577,797 | 12/1951 | Moyer . | |
| 2,767,782 | 10/1956 | Anthes | 137/888 |
| 2,957,495 | 10/1960 | Ashbrook | 137/888 |
| 3,826,474 | 7/1974 | Pareja | 137/888 |
| 4,611,641 | 9/1986 | Carter, Sr. . | |

*Primary Examiner*—A. Michael Chambers

*Attorney, Agent, or Firm*—Larry R. Cassett

[57] ABSTRACT

A gas cylinder has mounted therein a venturi device through which the constituents of a gas mixture pass when the cylinder is being filled with gas. The venturi device causes rapid and thorough mixing of the various constituents of the gas mixture.

2 Claims, 1 Drawing Sheet

GAS CYLINDERS VENTURI DIP TUBE

TECHNICAL FIELD

The present invention relates to gas cylinders and in particular to gas cylinders in which two or more constituents of a gas mixture are contained.

BACKGROUND OF THE PRIOR ART

Mixtures of gases are frequently used in welding operations, for example, a mixture of gases can be used for shielding purposes during metal inert gas (MIG) welding operations.

Welding gas mixtures are invariably transported in special gas cylinders between a first location at which the cylinders are filled with the various constituents of the gas mixture and a location at which the welding operation is to take place.

In order to maintain a uniform consistency of gas mixture leaving a cylinder during, for example, a welding operation it is necessary that the constituents are thoroughly mixed either when entering or after entry within the interior of the cylinder. In order to provide for adequate gas mixing it is known to roll cylinders or leave them free standing on their sides. However, this known method has disadvantages in that larger cylinders can weigh in the order of 300 lbs which means considerable effort has to be expended to manoeuvre the cylinders to ensure adequate mixing.

To avoid the necessity of rolling heavy cylinders so-called "dip tubes" have been used which depend from the usual gas valve to be found at one end of the cylinder and into the interior of the cylinder. Each tube is sealed at its distal end and spaced holes are provided along its length. These known dip tubes have been used to mix gases in a cylinder with varying degrees of success.

It is an aim of the present invention to provide a gas cylinder which includes a venturi device located within the cylinder which functions to mix two or more constituents of a gas mixture at the time the cylinder is being filled with said constituents.

SUMMARY OF THE INVENTION

According to one aspect of the present invention, a gas cylinder for containing gas mixtures comprises a gas valve for controlling the flow of gas into the cylinder and a venturi device located within the cylinder and positioned such that gas entering the cylinder from the gas valve flows through the venturi device.

In a preferred embodiment the venturi device depends from the gas valve.

According to a further aspect of the present invention a method of filling a cylinder with a gas mixture comprising at least two constituents comprises the steps of:

a) passing a first constituent under pressure through a gas valve and into the cylinder via a venturi device depending from the gas valve within the cylinder; and b) passing the second constituent through the gas valve and into the cylinder via the venturi device as with the first constituent; the flow of the second constituent through the venturi device creating a venturi effect such that both constituents are thoroughly mixed.

In a preferred embodiment the flow rate of the second constituent as it leaves the venturi device is in excess of 500 liters per minute.

BRIEF DESCRIPTION OF THE DRAWINGS

An embodiment of the invention will now be described by way of example reference being made to the Figures of the accompanying diagrammatic drawings, in which.

DETAILED DESCRIPTION OF THE INVENTION

Figure 1:
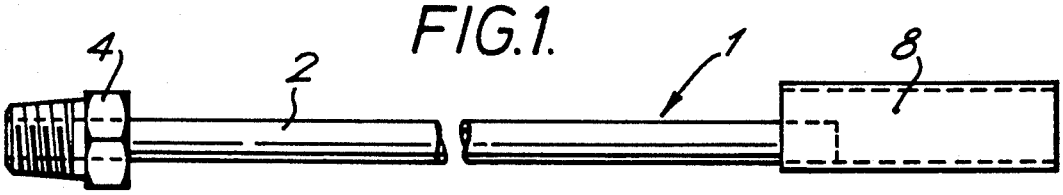
FIG. 1 is a side view of a venturi device.

As shown, a venturi device 1 comprises a main tube 2 which at its proximal end is provided with a hollow plug 4 for attachment to a gas valve (not shown) mounted on one end of a cylinder 6. The main tube 2 which may be made from 16 gauge, 0.25 outside diameter half hard copper has attached to its distal end an outer shell 8 which may be made from 15 mm outside diameter copper tube. The outer shell 8 is attached to the main tube 2 as by brazing and as shown most clearly in FIG. 1, surrounds the distal end of the main tube 2.

Figure 3:
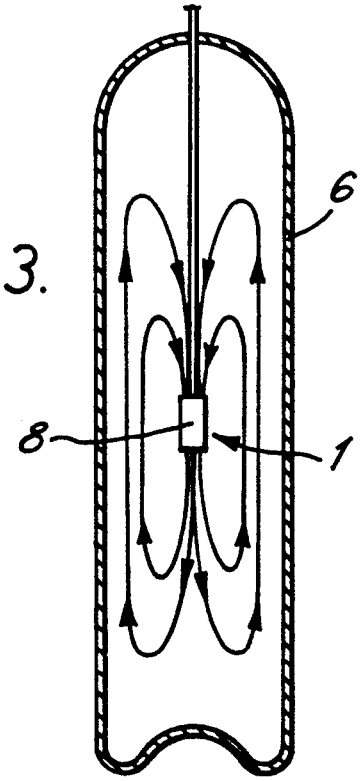
FIG. 3 is a cross-section of a cylinder in which the venturi device of FIGS. 1 and 2 is located.

As shown in FIG. 3, the venturi device 1 is mounted vertically in the center of the cylinder 6.

In use, when it is desired to fill the gas cylinder 6 with a mixture of gases, a first constituent gas is passed under pressure through the gas valve (not shown), main tube 2 and through the outer shell 8 and into the main body of the cylinder 6.

Figure 2:
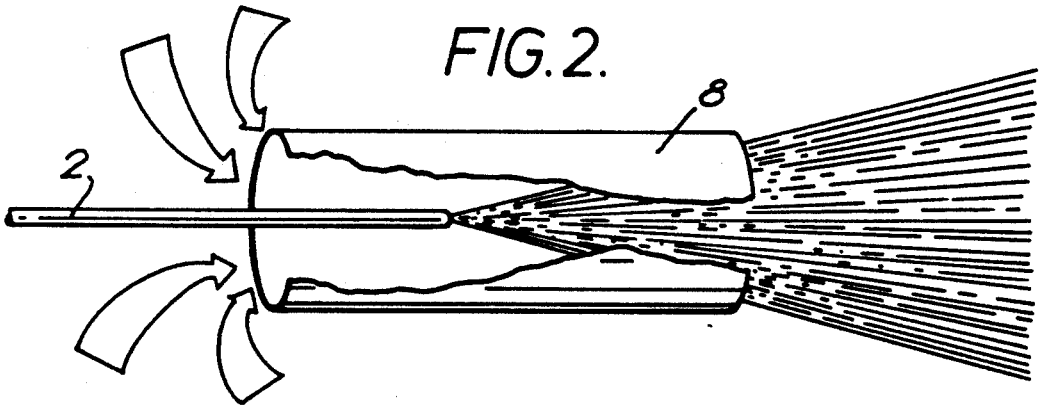
FIG. 2 is a diagrammatic perspective sketch of the distal end of the venturi device illustrated in FIG. 1.

The next or remaining gas constituent is then passed in the same manner through the gas valve, venturi device 1, and into the main body of the cylinder 6. However, in flowing out from the distal end of the main tube within the outer shell B a venturi effect is created causing entrainment of the first constituent which is drawn into the shell 8 as indicated by the arrows in FIG. 2.

FIG. 3 also illustrates the general gas flow as the second constituent passed through the outer shell 8.

It is preferable that the flow rate of the second constituent be at least 500 liters per minute as it leaves the distal end of the main tube 2. However, lower flowrates will give good mixing for some gas mixtures and internal diameters of cylinders.

It has been found that the venturi device 1 when fitted to a gas cylinder 6 is a significant improvement over the known dip tubes and other methods of mixing gases.

It will be appreciated that the main tube 2 and outer shell 8 can have varying dimensions from those mentioned in the above described embodiment. It has been found that the dimensions of the gas cylinder and the physical properties of the gases to be mixed dictate the final dimensions of the venturi device 1. Furthermore, the venturi device 1 can be made from material other than copper.

I claim:

1. A gas cylinder for containing gas mixtures comprising a gas valve for controlling the flow of gas into the cylinder and a venturi device depending from the gas valve, the venturi device including a main tube attached to the gas valve and an outer shell attached to the main tube at or adjacent the distal end of said main tube and surrounding said distal end, the venturi device being located within the cylinder and positioned such that gas entering the cylinder from the gas valve flows through the venturi device.

2. A cylinder as claimed in claim 1, in which the outer shell is attached to the main tube by a brazed connection.

* * * * *